United States Patent [19]

Yoneda

[11] 4,290,292

[45] Sep. 22, 1981

[54] MANUFACTURE OF ROTATABLE IGNITION FILES OR FLINT WHEELS

[76] Inventor: Yushin Yoneda, 1788, Mebuki, Noda City, Chiba Prefecture, Japan, 278

[21] Appl. No.: 71,553

[22] Filed: Aug. 30, 1979

[51] Int. Cl.[3] ..... B21D 31/02

[52] U.S. Cl. ..... 72/330; 72/340; 72/356

[58] Field of Search ..... 72/354, 356, 352, 331, 72/335, 340, 330

[56] References Cited

U.S. PATENT DOCUMENTS

| | | | |
|---|---|---|---|
| 3,124,876 | 3/1964 | Puetti | 72/356 X |
| 3,186,209 | 6/1965 | Friedman | 72/356 X |
| 3,399,560 | 9/1968 | Connolly | 72/356 |
| 3,413,945 | 12/1968 | Bertoglio | 72/356 |

FOREIGN PATENT DOCUMENTS

| | | | |
|---|---|---|---|
| 362238 | 10/1922 | Fed. Rep. of Germany | 431/273 |

*Primary Examiner*—Leon Gilden

*Attorney, Agent, or Firm*—Holman & Stern

[57] ABSTRACT

Elongate wire stock of gauge appropriate to the desired diameter of a rotatable ignition file or flint wheel is cut into blanks of suitable size. A series of press operations is applied to the blanks by means of respective punches and dies to champfer or round off the peripheral edges of the blanks, to provide axial mounting holes, and to harden the respective surfaces of the blanks. The circumferential surfaces of the respective blanks are formed as friction surfaces.

5 Claims, 12 Drawing Figures

MANUFACTURE OF ROTATABLE IGNITION FILES OR FLINT WHEELS

DESCRIPTION

This invention is concerned with the manufacture of rotatable ignition files or flint wheels, for example for lighters.

In accordance with the present invention, I provide a method of manufacturing rotatable ignition files or flint wheels, for example for lighters, comprising the steps of: cutting elongate wire stock of gauge appropriate to the desired diameter of the wheel into blanks of suitable size; and applying a series of press operations to the blanks by means of respective punches and dies to champfer or round off the peripheral edges of the blanks, to provide axial mounting holes, and to harden the respective surfaces of the blanks; and the circumferential surfaces of the respective blanks being formed as friction surfaces.

Preferably the series of press operations comprise the following steps in order: guiding the cut blank into a die hole and applying pressure thereto by a pair of opposed punches to initially shape the blank; champfering or rounding off the peripheral edge of the blank at one axial end surface thereof by charging the shaped blank into a second die hole having a bottom formed with a rounded peripheral edge and applying pressure to the blank by means of a co-operating punch; thereafter champfering or rounding off the peripheral edge of the blank at its other axial surface and simultaneously providing a central recess in each axial end surface of the blank by inverting the blank and charging it into a die hole having a bottom with a rounded peripheral edge and a small diameter guide channel for a small diameter punch opening in the centre of the said bottom, and applying pressure to the inverted blank in the bottom of the said die hole between a co-operating punch formed with a forward end protrusion on its axial centre line and the said small diameter punch; and thereafter forming a through aperture along the axial centre line of the blank by means of a punch die.

It should be appreciated that the above sequence of steps is merely that which we prefer and alternative steps are feasible, as are additional steps, as desired.

The invention is hereinafter more particularly described by way of example only with reference to the accompanying drawings, in which.

Figure 1:
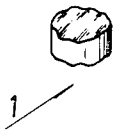
FIG. 1 is a perspective view of a raw cut blank.
Figure 2:
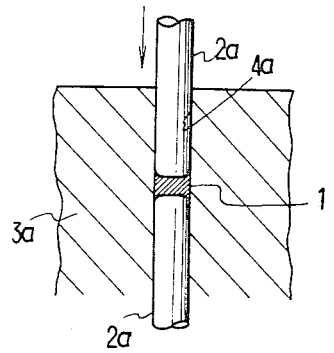
FIG. 2 is a sectional view illustrating the step of initially shaping the blank.
Figure 3:
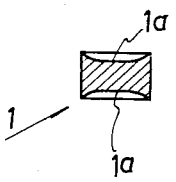
FIG. 3 is a sectional view through the initially shaped blank.

Elongate wire stock (such as iron wire) of gauge appropriate to the desired diameter of the finished wheel is first cut into blanks 1 of suitable size. The blank 1 is charged into hole **4*a* of a die 3*a* having a pair of cooperating punches 2*a*,2*a* for applying pressure to the blank 1 to give it an initial shape suitable for subsequent working. As will be seen from FIG. 3, the initial shape has respective recesses 1*a*** in each axial end surface.

Figure 4:
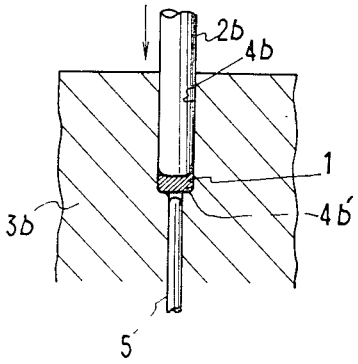
FIG. 4 is a sectional view illustrating a subsequent stage of champfering or rounding off one peripheral edge of the blank.
Figure 5:
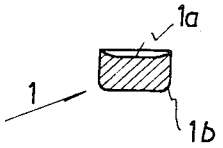
FIG. 5 shows the blank in section after application of the step illustrated in FIG. 4.
Figure 6:
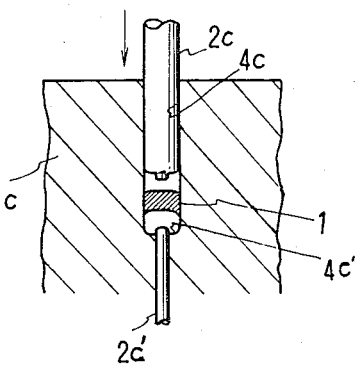
FIG. 6 illustrates a subsequent step of champfering or rounding off the other peripheral edge surface and forming recesses in the opposite axial faces of the blank.

The thus initially shaped blank is charged into a second die having a die hole **4*b*, and pressure is applied to the blank by means of a co-operating punch 2*b*. The bottom surface 4*b*′ has a champfered or rounded peripheral edge so that after the operation illustrated in FIG. 4 when the blank 1 is pushed out of the die by means of a pin 5, it has the configuration shown in FIG. 5, from which figure it will be seen that the blank has a rounded or champfered peripheral edge 1*b***.

Figure 7:
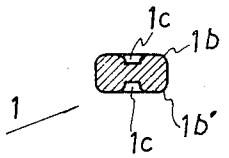
FIG. 7 shows the blank at the end of the operation illustrated in FIG. 6.
Figure 8:
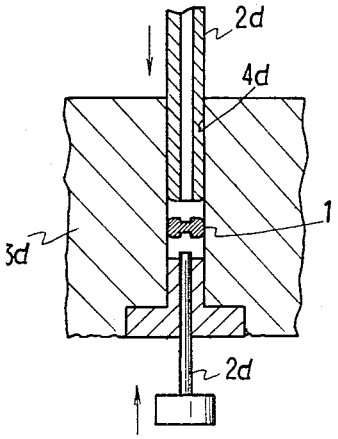
FIG. 8 illustrates a yet subsequent stage in which an axial hole is punched through the blank.
Figure 9:
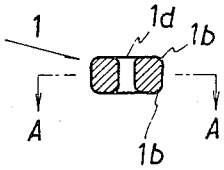
FIG. 9 shows in section the blank at the end of the operation illustrated in FIG. 8.
Figure 10:
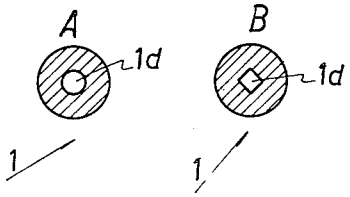
FIG. 10 shows two alternative embodiments of blanks at the end of the operation illustrated in FIG. 8, the blanks being shown in section taken along the line A—A in FIG. 9.
Figure 11:
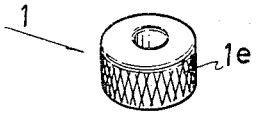
FIG. 11 shows a perspective view of the finished rotatable ignition file or flint wheel.

The blank is then inverted and charged into the die hole **4*c* of a further die also formed with a champfered or rounded peripheral edge to its bottom surface 4*c*′. In this case, an aperture of relatively small diameter in which is received a punch 2*c*′ of relatively small diameter opens into the centre of bottom surface 4*c*′ . The punch 2*c* also has an axial protrusion in its end surface. Pressure is applied to the blank 1 in the bottom of the die hole 4*c* between the main punch 2*c* and the small diameter punch 2*c*′ so that the second axial end surface of the blank is formed with a champfered or rounded periphery at 1*b*′ and respective recesses 1*c* are formed in the centre of the respective axial end surfaces (FIG. 7**).

The blank 1 is next charged into the die hole **4*d* of a conventional punch die 3*d* and a round, or alternatively square, cross-sectioned hole 1*d* is punched through the blank at the position of the recesses 1*c* by means of cooperating hole making punches 2*d*,2*d***.

The blank 1 may then be quenched and a friction surface is formed at the periphery of the wheel, for example by forming file cuts **1*e***, to complete formation of the wheel.

As will be appreciated from the foregoing description, the series of co-operating punches and dies **2*a*,3*a*; 2*b*,3*b*; 2*c*,3*c*; and 2*d*,3*d*** may be operated by relatively unskilled personnel. The presently described method avoids the need for skilled cutting of blanks, avoids the need for skilled cutting of the peripheral edges of the blanks by means of champfering tooling, which avoids the creation of cut chips of the material, and avoids any need to drill the so-formed champfered blanks.

We have found that there is less wastage of material by employing the series of punch operations as described hereinabove than there would be in seeking to perform similar operations by cutting tools. Moreover, even with relatively unskilled personnel, the resultant blanks prior to the cutting operation are relatively more uniform so that the file cuts **1*e*** can be more readily formed and there is less likelihood of sharp edges to those cuts being created which would tend to lacerate the finger of the user of a lighter.

Figure 12:
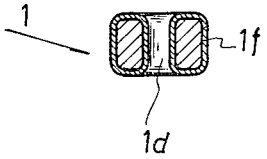
FIG. 12 shows the wheel of FIG. 11 in section.

The series of punch operations further has the effect of forming an outer hardened layer **1*f* (see FIG. 12**) on the wheel having better hardness properties, tensile strength and yield point and a wear resistance which may be two to three times more than for flint wheels formed by other processes.

I claim:

1. A method of manufacturing rotatable ignition files or flint wheels, for example for lighters, comprising the steps of: cutting elongate wire stock of gauge appropriate to the desired diameter of the wheel into blanks of suitable size; applying a series of press operations to the blanks, as cut, by means of respective punches and dies to champfer or round off the peripheral edges of the blanks, to provide axial mounting holes, and to harden the respective surfaces of the blanks; and treating the circumferential surfaces of the respective blanks being formed to provide friction surfaces.

2. A method according to claim 1, wherein the friction surface is provided on each blank at the end of the press operations.

3. A method according to claim 1 or claim 2, wherein the press operations comprise the following steps in order: guiding the cut blank into a die hole and applying pressure thereto by a pair of opposed punches to initially shape the blank; rounding off the peripheral edge of the blank at one axial end surface thereof by charging the shaped blank into a second die hole having a bottom formed with a rounded peripheral edge and applying pressure to the blank by means of a co-operating punch; thereafter rounding off the peripheral edge of the blank at its other axial surface and simultaneously providing a central recess in each axial end surface of the blank by inverting the blank and charging it into a die hole having a bottom with a rounded peripheral edge and a small diameter guide channel for a small diameter punch opening in the centre of the said bottom, and applying pressure to the inverted blank in the bottom of the said die hole between a co-operating punch formed with a forward end protrusion on its axial centre line and the said small diameter punch; and thereafer forming a through aperture along the axial centre line of the blank by means of a punch die.

4. A method according to claim 3, wherein said wire stock consists of iron wire.

5. A method according to claim 1 or claim 2 wherein said wire stock comprises iron wire.

* * * * *